United States Patent [19]

Cavanna et al.

[11] 4,156,492

[45] May 29, 1979

[54] VESSEL SUPPORT APPARATUS

[75] Inventors: Cesar E. Cavanna, Livermore; Dale Bastian, San Ramon; Stanley Kungys, Novato, all of Calif.

[73] Assignee: Lox Equipment Company, Livermore, Calif.

[21] Appl. No.: 810,312

[22] Filed: Jun. 27, 1977

[51] Int. Cl.[2] ..... B65D 25/00; B65D 25/18

[52] U.S. Cl. ..... 220/435; 220/429

[58] Field of Search ..... 220/15, 9 R, 9 A, 9 LG, 220/10, 85 S, 429, 435, 437

[56] References Cited

U.S. PATENT DOCUMENTS

| | | | |
|---|---|---|---|
| 3,129,836 | 4/1964 | Frevel | 220/15 |
| 3,305,122 | 2/1967 | Pringle | 220/15 |
| 3,425,583 | 2/1969 | Bridges | 220/15 |
| 3,839,981 | 10/1974 | Gilles | 220/9 LG X |
| 3,853,240 | 12/1974 | Alleaume | 220/9 LG X |
| 3,903,824 | 9/1975 | Laverman et al. | 220/429 X |
| 3,978,808 | 9/1976 | Cuneo et al. | 220/9 LG X |
| 4,013,030 | 3/1977 | Stafford | 220/9 LG X |

*Primary Examiner*—William Price
*Assistant Examiner*—Steven M. Pollard
*Attorney, Agent, or Firm*—Bielen and Peterson

[57] ABSTRACT

A container support apparatus for a container having an outer vessel and an inner vessel within. A first support fixed to the inner vessel projects towards the outer vessel. A second support fixed to the outer vessel projects towards the inner vessel. A third support contacts the first and second supports to form a support unit which substantially prevents contact or touching between the inner and outer vessels. Means for heat insulating the first vessel from the second vessel through the support unit is included.

23 Claims, 7 Drawing Figures

FIG-4
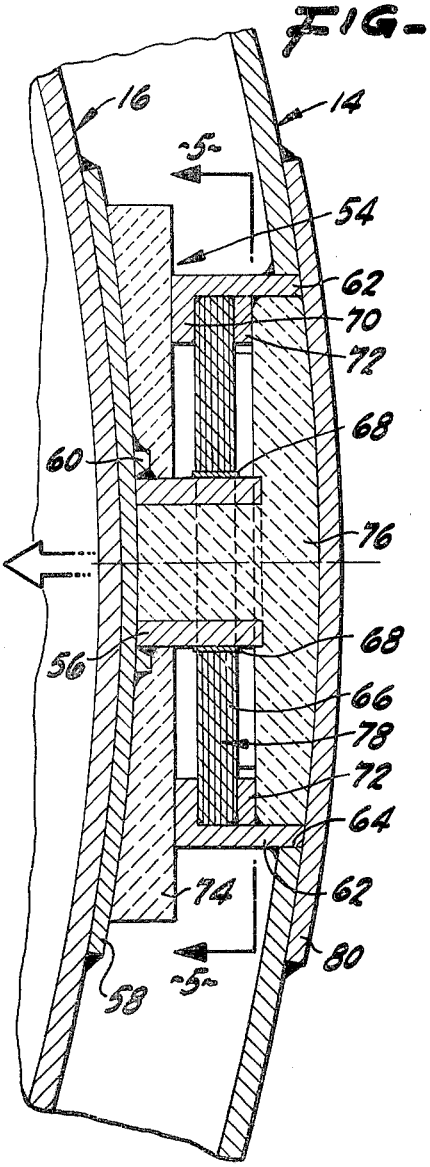
FIG-5
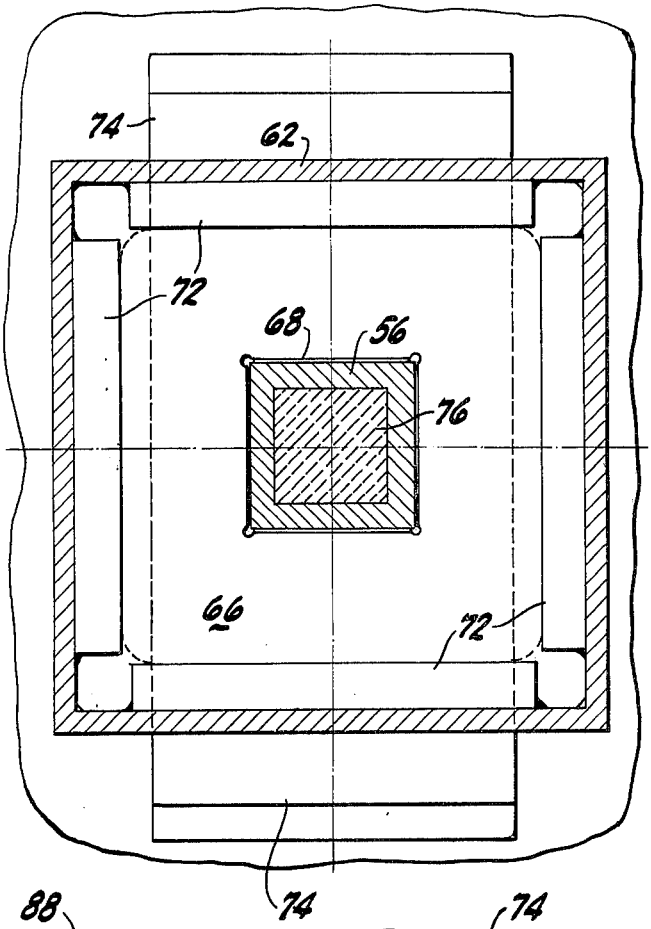
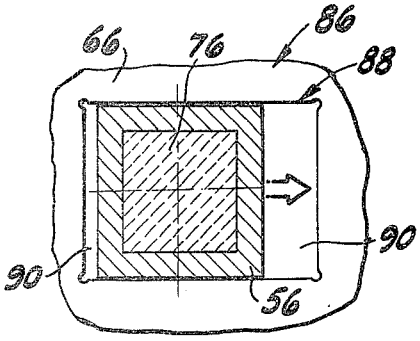
FIG-7
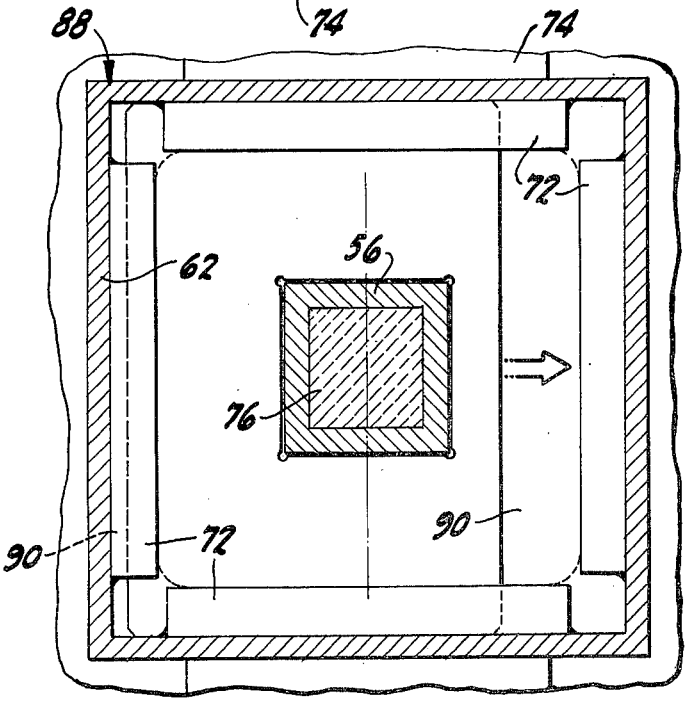
FIG-6

VESSEL SUPPORT APPARATUS

BACKGROUND OF THE INVENTION

Containers of cryogenic liquids present special problems of construction and design. Such containers are often formed of multiple vessels, one inside another which inherently provides superior insulating qualities necessary to maintain cryogenic liquids at extremely low temperatures.

Further problems arise when quantities of cryogenic liquids are transported within cryogenic containers via the known modes of travel. Weight limitations commonly placed on land vehicles has prompted the development of aluminum and other likely containers to maximize the payload of cryogenic materials.

In the past, supporting one vessel within another with the minimization of the paths of heat migration through the support structure has been a difficult problem. The use of lightweight materials having a high coefficient of linear expansion requires special considerations because of the bending or "banana" effect associated with the uneven contraction of a relatively large sized vessel of cylindrical configuration. Also, provision must be made for the relatively large thermal contraction of an inner vessel of a lightweight material having a high coefficient of linear expansion and an outer vessel having a relatively low coefficient of linear expansion. Moreover, a similar situation exists where the inner vessel is exposed to a lower temperature than an outer vessel constructed of the same material as the inner vessel. For example, where the inner and outer vessels are constructed of aluminum, an inner vessel contacting liquid nitrogen would contract approximately 4 cm more than an aluminum outer vessel.

Prior cryogenic vessels have focused on the problem of minimizing the inward migration of heat. For example, U.S. Pat. No. 3,782,128, issued Jan. 1, 1974 to Hampton et al describes a novel cryogenic storage vessel having both transverse and longitudinal support structures to prevent transverse or radial and longitudinal displacements. No known prior art solves the problems encountered with vessels constructed of lightweight, highly expansive or contractive materials.

The present invention relates to a novel container support apparatus particularly useful in transporting cryogenic materials.

SUMMARY OF THE INVENTION

In accordance with the present invention, a novel container support apparatus is provided. The container employs an outer vessel and an inner vessel substantially within the outer vessel. A first support is fixed to the inner vessel and projects towards the outer encapsulating vessel. A second support is likewise fixed to the outer vessel and projects back toward the inner vessel. To complete the support system, a third support contacts both the first and second supports to separate or space the outer vessel from the inner vessel. Means for heat insulating the inner vessel from the outer vessel is included in the support unit. Such heat insulating means may take the form of constructing the third support of insulating material having remarkable structural strength. In addition, other insulating material may be placed between the inner and outer vessel to reduce convection and radiation heat from entering inner vessel.

The invention may also have means for permitting movement of the first support connected to the inner vessel, relative to the second support connected to the outer vessel. Movement of the first support would occur during expansion and contraction of the inner vessel a greater amount than the surrounding outer vessel. Such movement permitting means may take the form of a third support substantially surrounding the first support. The third support could provide a space to allow movement of the first support with thermally instigated changes of the inner vessel. Also, the first and third supports could be rigidly affixed to each other and the second support could provide a space for movement of the third support with heat induced variations of inner vessel's dimensions.

Where the inner and outer vessels are elongated bodies, the support unit may be considered as first holding means for fixing the inner vessel to the outer vessel as well as second holding means for adjustably supporting the inner vessel to the outer vessel. First and second holding means would be spaced about the periphery of the vessels and preferably inwardly from the ends of the elongated vessels. By this embodiment, the inner vessel freely moves along its axis with reduced height of bowing at its central portion.

To distribute the load or bending moment found at the support units, the container support apparatus may have means for distributing loads exerted thereat. In one embodiment such load distributing means may include a pad fixed to the exterior of the inner vessel. A stiffener circumferentially fixes to the interior of the inner vessel opposite the outer pad. In other words, a sandwich of the circumferentially affixed stiffener, portion of the inner vessel, and the pad is formed. Additional load distribution at the support units may take place by the installation of a longitudinal stiffener fixed to the interior of said inner vessel opposite the pad. The pad provides a welding surface for the first support heretofore described. The outer vessel may be reinforced longitudinally with exterior stiffeners. In general, the container outer vessel is constructed of heavier and stronger material since the outer vessel is essentially stable, remaining straight during cryogenic materials' handling. On the other hand, the inner vessel is not restrained during movements resulting from extreme heating and cooling thereof.

The inner vessel may also include baffle means for diminishing the movement of cryogenic materials therewithin. Such baffle means may externalize in a multiplicity of baffles asymmetrically spaced within said inner vessel. This particular spacing arrangement prevents excessive free surface waves or harmonic forces that normally arise during acceleration of a moving container.

As may be apparent, a new and useful cryogenic container support system has been described.

It is therefore an object of the present invention to provide a container support apparatus usable with cryogenic materials and multiple vessel containers wherein each of said vessels are constructed of materials having different coefficients of linear expansion.

It is another object of the present invention to provide a container support apparatus for a container having an inner and outer vessel and to minimize the deleterious effects of the bending of the inner vessel into a banana shape during cooling of the inner vessel by cryogenic materials.

It is yet another object of the present invention to provide a container support apparatus for a container having an inner and outer vessel where the outer vessel is relatively rigid and the inner vessel exhibits thermally induced expansions and contractions, such that the relatively rigid outer vessel supports do not inhibit such movement of the inner vessel.

It is still another object of the present invention to provide a container support apparatus for a container having an inner and outer vessel where the reinforcement of the container takes place primarily in the outer vessel to facilitate construction, maintenance, and repair of the container.

Another object of the present invention is to provide a container support apparatus for cryogenic materials having an inner vessel supported by an outer vessel where the inner vessel is insulated against migration of heat from said outer vessel's support mechanism.

The invention possesses other objects and advantages, especially as concerns particular features and characteristics thereof, which will be revealed as the specification continues.

Various aspects of the present invention will evolve from the following detailed description of the preferred embodiments thereof, which should be taken in conjunction with the accompanying drawings.

BRIEF DESCRIPTION OF THE DRAWINGS

FIG. 4 is a broken view taken along line 4—4 of FIG. 1.

FIG. 5 is a view taken along line 5—5 of FIG. 4.

FIG. 6 is a view taken along line 6—6 of FIG. 1

FIG. 7 is a view taken along line 7—7 of FIG. 1.

DESCRIPTION OF THE PREFERRED EMBODIMENTS

Figure 1:
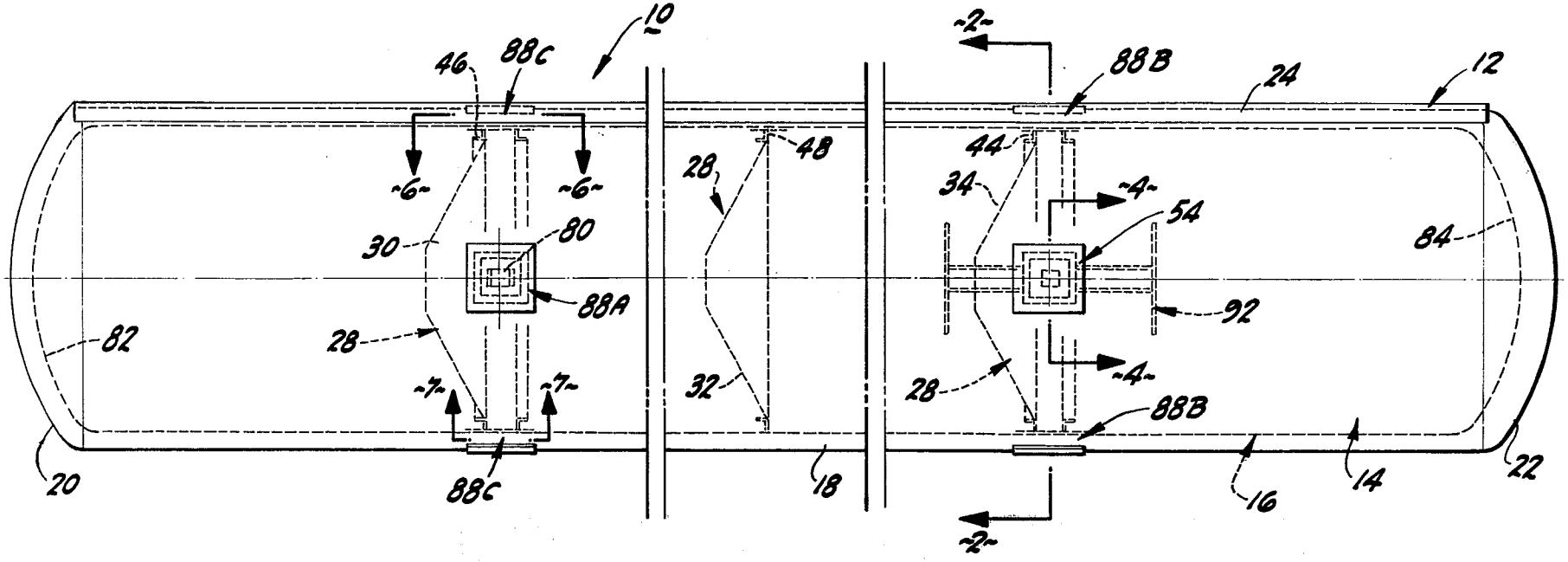
FIG. 1 is a side elevational view of the container.

The invention a whole is shown in the drawings by reference character 10. A container 12 includes an outer vessel 14 and an inner vessel 16 substantially within outer vessel 14, FIG. 1.

Outer vessel 14 may be constructed of relatively rigid material and possess structural strength to support inner vessel 16. For example, outer vessel 14 may be formed of steel, aluminum, or other metallic materials welded together from preformed plates. The outer vessel depicted in the drawings is an elongated body having a cylindrical section 18 with end portions 20 and 22 having a spherical configuration. The overall length of container 12 is approximately twelve (12) meters. Longitudinal stiffeners 24, 26 are welded to the exterior of the outer vessel 14.

Baffle means 28 diminishes the movement of cryogenic materials within inner vessel 16 and reduces the potentially dangerous free surface effect resulting therefrom. Baffle means 28 may include a multiplicity of baffles 30, 32, and 34 asymmetrically spaced within inner vessel 16. Such spacing tends to reduce the harmonic wave action associated with the free surface effect of the liquid cryogenics within inner vessel 16. Baffle 34, illustrated in FIG. 2, may be deemed as typical of all the baffles found within inner vessel 16. Baffle 34 includes a plurality of holes two to three centimeters in diameter on a conically-shaped section 38. Access opening 40 permits communication with the sectioned inner vessel. Opening 42 holds a filling pipe for the cryogenic materials. Stiffener ring 44, welded to the interior circumference of inner vessel 16, fixedly supports baffle 34. Likewise, rings 46 and 48 support baffles 30 and 34, FIG. 1.

Inner vessel 16 is preferably constructed of a lightweight material such as, but not limited to, aluminum and its alloys. Although aluminum possesses a low density, it also possesses a relatively high coefficient of linear expansion. In general inner vessel 16 will expand and contract with heating and cooling to a much greater extent than outer vessel 14, either because of a difference in the coefficient of linear expansion of the dissimilar materials used to construct outer and inner vessels 14 and 18, or because of the direct contact of inner vessel 16 with the cryogenic liquid. Inner vessel 16 is typically constructed by welding plates together.

The filling of inner vessel 16 with a cryogenic fluid produces a bending of the vessel into a slightly upwardly convex configuration, commonly known as "the banana effect". Inner vessel 16 derives its support from outer vessel 14 and is separated therefrom such that the space between the vessels may be filled with insulation 50 such as perlite, fiberglass, and other like insulation known in the art. Insulation pads 52 locate on the top and bottom portions of the space between inner and outer vessels 16 and 14 in a more permanent posture than insulation 50 which is free to shift therein. Also insulation may be placed between outer vessel 14 and inner vessel 16 between ends 22 and 84 and ends 20 and 82 thereof.

Turning to FIG. 4, first holding means or support units 54 are most clearly depicted therein. Support unit 54 includes a first support 56 fixed to inner vessel 16 by way of a welding pad 58. Base pad 60 firmly attaches to the exterior of inner vessel 16 and is shown in FIG. 4 as welded both to pad 58 and first support 56. Second support 62 welds to the edge of outer vessel 14 surrounding opening 64 therethrough. First support 56 projects towards outer vessel 14 and second support 62 projects towards inner vessel 16. First support 56 is essentially framed by second support 62 in the embodiment shown. Third support 66, which may include shims 68, contacts first and second supports 56 and 62 to form each support unit 54. In the specific embodiment shown in FIG. 4, second support 62 includes a leg 70 which limits the travel of the third support 66 in conjunction with insulation blocks 72. Insulation blocks 74 and 76 provide additional insulation and also serve to limit the migration of perlite 50 into support unit 54.

The container support apparatus also has as one of its elements means 78 for heat insulating inner vessel 16 from outer vessel 14 by conduction through support unit 54. In the embodiment shown on FIG. 4, means 78 takes the form of constructing third support 66 of low heat conductive material of high structural strength, such as a reinforced plastic. Cover plate 80 protects support unit 54 from contact with the environment external to outer vessel 14. FIG. 5 depicts the specific arrangement of support unit 54 beneath cover plate 80.

FIG. 1 illustrates a distribution of support units 84 on container 12. It should be noted that the overall length of container 12 has been shortened by broken sections on the FIG. 1. As heretofore described, inner vessel 16 may be fabricated of a material having a coefficient of linear expansion (and therefore contraction) which is greater than the material used to construct outer vessel 14. The loading of a cryogenic material to inner vessel 16 causes inner vessel 16 to contract longitudinally and radially. For example, if inner vessel were built of aluminum, it would contract approximately one-third centimeter per meter in length. The vessel illustrated in FIG. 1 includes two support units or first holding means 54 located inwardly from the end 22 of outer vessel 14 and the end 84 of inner vessel 16. Ends 22 and 84 of container 12 may be referred to as the fixed end or piping end of the container 12. In general, support units or first holding means 54 absorb forces along the longitudinal axis of container 12 as well as the vertical force caused by gravity, and vertical forces generated by the motion of container 12 during transport.

The apparatus 10 may additionally have means 86 for permitting movement of first support 56 relative to second support 62 during thermal expansion and contraction of inner vessel 16 relative to outer vessel 14. FIG. 7 shows means 86 in the form of second holding means or adjustable support units 88 for adjustably supporting inner vessel 16 by outer vessel 14. The embodiments of container 10 shown has six adjustable support units 88. Inner vessel 16 has at least one variable dimension, in this case its longitudinal axis, because of the heretofore detailed thermal expansion and contraction. In particular second holding means 88 includes the first, second, and third supports 56, 62, and 66 of first holding means 54 and space 90. Thus, the contraction of inner vessel 16 results in the movement of first support 56 within space 90, as well as radially to the axis of inner vessel 16 as shown by the directional arrow on FIGS. 4, 6, and 7. FIG. 6 depicts a variation of second holding means 88 where space 90 locates between third support 66 and second support 62.

Thus, first holding means or support units 54 and second holding means or adjustable support units 88 do not restrict the radial contraction of inner vessel 16. As may be apparent, first supports 56 move freely radially also. The longitudinal forces in both directions are taken up by support units 54 on either side of the vessel. As heretofore stated, vertical forces bear on support units 54 and two adjustable support units 88A (one shown in FIG. 1 and one positioned diametrically on container 10 in relation to support units 88A shown). In addition support units 88B permit the upward movement of inner vessel 16 in assumption of the "banana" shape while restricting transverse forces and longitudinal forces in one direction. Finally, adjustable support units 88C meet transverse forces only.

Although inner vessel 16 does not require longitudinal stiffeners, because of the inward location of support unit 54, a bending moment occurs at the ends of container 12.

Figure 2:
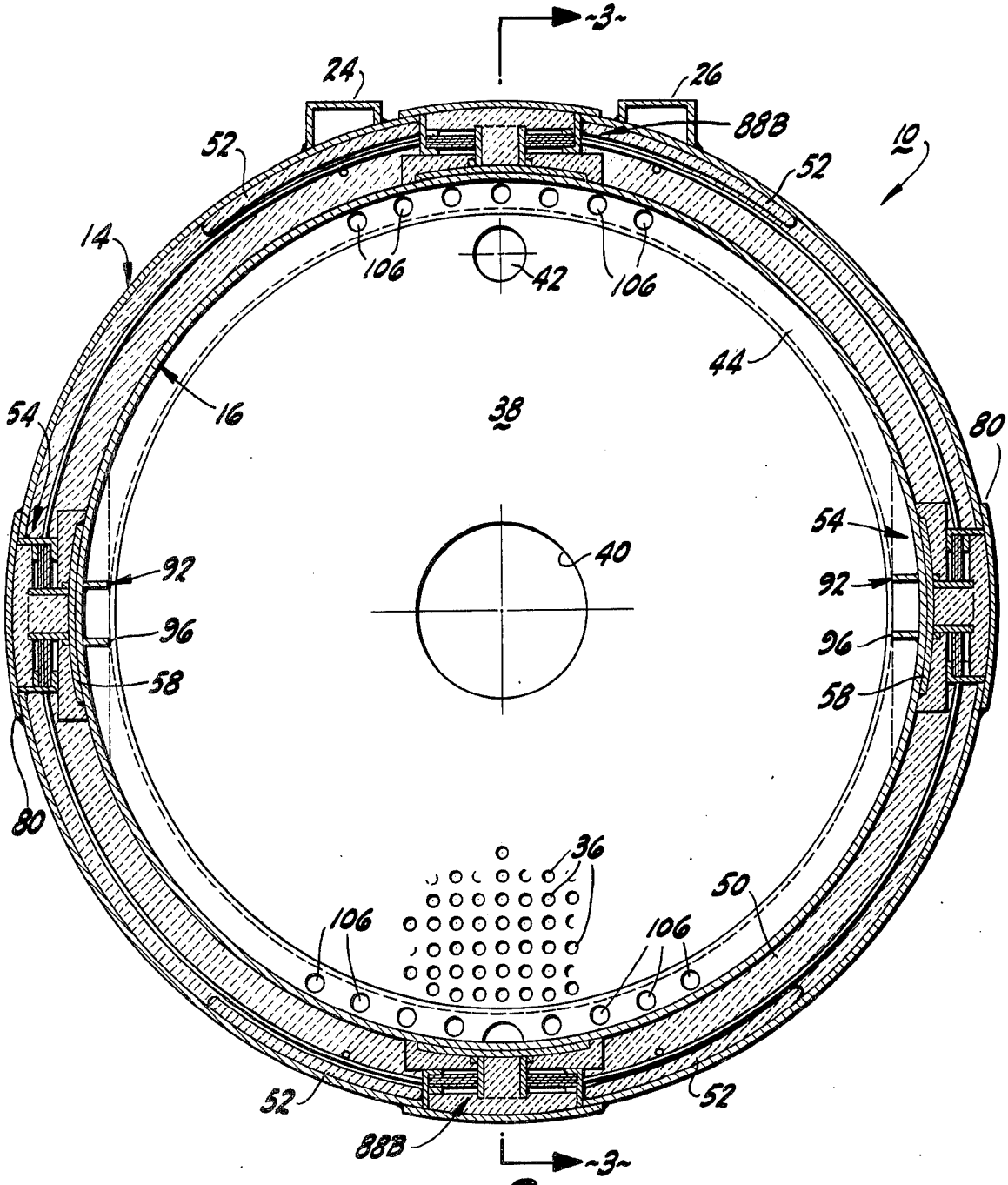
FIG. 2 is a view taken along line 2—2 of FIG. 1.
Figure 3:
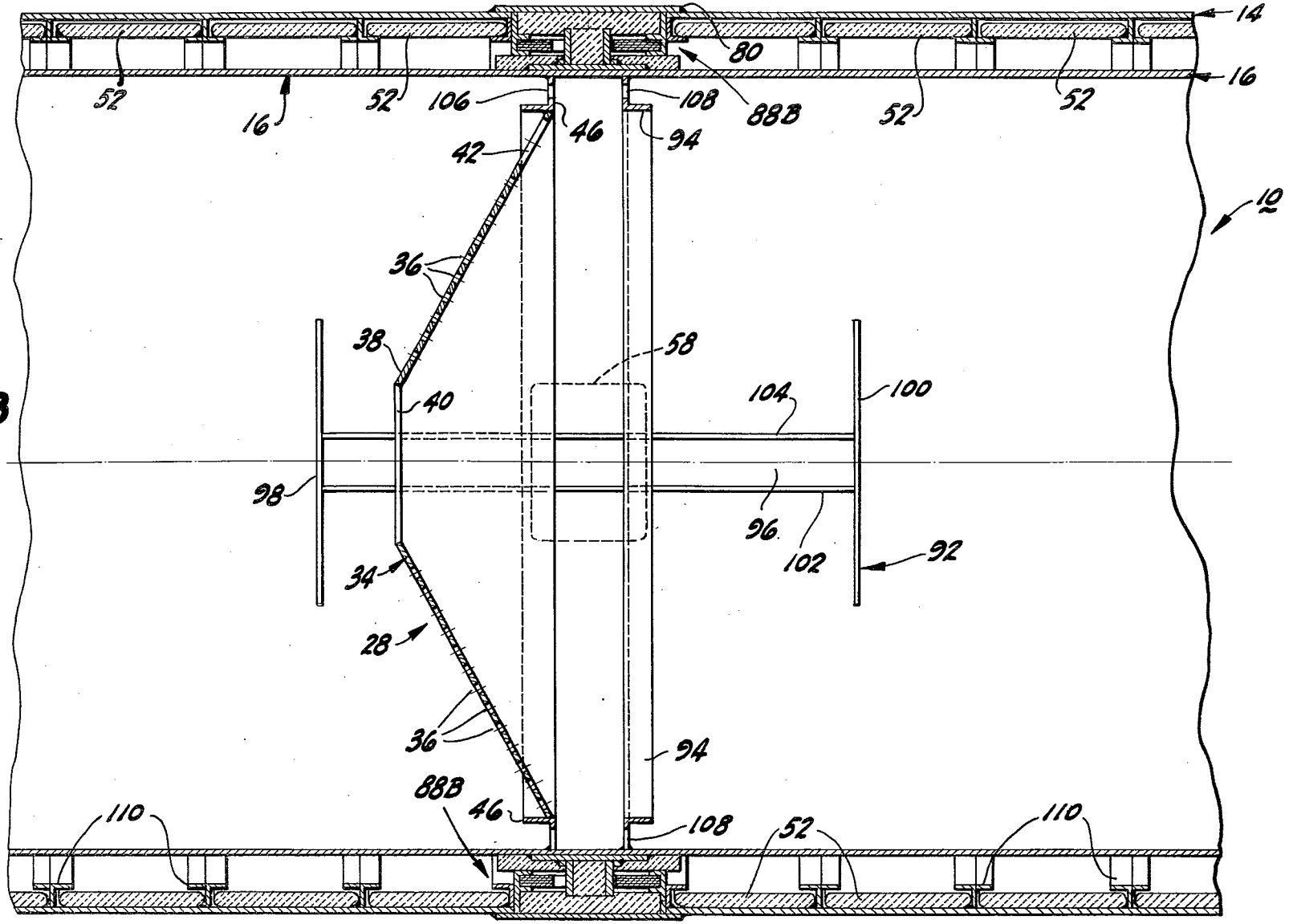
FIG. 3 is a broken view taken along line 3—3 of FIG. 2.

The container support apparatus 10 may embrace means 92 for distributing longitudinal loads exerted at first holding means or support unit 54. FIGS. 2 and 3 illustrate an embodiment of means 92 which includes pad 58 welded or otherwise affixed to the interior of inner vessel 16. Stiffener 94 circumferentially affixes to the interior of inner vessel 16, preferably be welding. A portion of circumferential stiffener 94 positions opposite pad 58 with said inner vessel 16 being intermediate pad 58 and stiffener 94. In addition, a relatively short longitudinal stiffener 96 affixes to the interior of inner vessel 16 also. A portion of stiffener 96 positions opposite pad 58. Stiffener 96 and pad 58 sandwich a portion of inner vessel 16. Stiffener 96 includes end portions 98 and 100 as well as longitudinal bars 102 and 104. Stiffener 46 supporting baffle 38 may also be placed opposite pad 58 in a manner similar to stiffener 94. Stiffeners 46 and 94 include openings 106 and 108 which function in the same manner as holes 36, i.e.: to allow the transfer of cryogenic fluid within inner vessel 16. It should be noted that means 92 may include a pair of stiffeners 94 and 96 as well as a pair of pads 58 located on opposite sides of vessel 16 as shown in FIG. 2.

Outer vessel 14 requires a plurality of stiffeners 110 circumferentially affixed to the interior thereof to support the vacuum between inner and outer vessel 16 and 14.

Also, stiffeners 110 offer additional support to the apparatus 10.

In operation inner vessel 16 is filled with a cryogenic material compatible with the characteristics of the material used to construct the same. For example, an aluminum inner vessel 16 might be filled with liquid nitrogen. As the filling proceeds inner vessel 16 will contract, being cooled by conductive heat removal by the cryogenic liquid. First holding means or support unit 54 will fix the support of one end of inner vessel 16 and second holding means 88 will permit the adjustable support of the inner vessel 16 by allowing it to contract. The position of first and second holding means 54 and 88 minimizes the effect of the banana shape by the inner vessel 16 and impingement on the interior of outer vessel 14 thereby. Insulation pads 52 and insulation 50 as well as insulation means 78 greatly minimize the migration of heat from the external environment to the cryogenic liquid within inner vessel 16. Means 92 distributes the the bending moment which arises from the longitudinal forces on first and second holding means 54 and 88 from the ends 82 and 84 of inner vessel 16 and the ends 20 and 22 of outer vessel 16. Heating of container 10 to remove moisture results in slight expansion of inner vessel 16. Such expansion causes first supports 56 or third supports of adjustable support unit 88 to move within space 80 opposite to directional arrows on FIGS. 6 and 7. Likewise, first support 56 would move radially oppositely to the directional arrow in FIG. 4, in such a case. The container 12 may be supported in a stationary position or transported by trailer, rail, water carrier, air carrier, and the like.

While in the foregoing specification embodiments of the invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A support apparatus for a container having an outer vessel an inner vessel, and mobile solid matter, being a poor conductor of heat, interposed the inner and outer vessels comprising:

a. first suport adapted for fixation to the inner vessel and projecting toward the outer vessel;
b. second support adapted for fixation to the outer vessel and projecting toward the inner vessel;
c. third support contacting said first and second supports, said first, second, and third supports forming a support unit which substantially maintains the outer vessel from contact with the inner vessel;
d. means adapted for heat insulating the inner vessel from the outer vessel through said support unit;
e. means for guiding movement of said first support relative to said second support in a direction corresponding to a first dimension of the inner vessel; and f. means adapted for limiting migration of the mobile solid matter from between the inner and outer vessels to said means for guiding said first support relative to said second support along a first dimension of the inner vessel.

2. The container support apparatus of claim 1 in which said heat insulating means includes constructing said third support of heat insulating material.

3. The container support apparatus of claim 2 in which said third support substantially surrounds said first support and said means for guiding movement of said first support relative to said second support in a direction corresponding to a first dimension of the inner vessel includes providing a space between said first support and said third support having an inner vessel bearing surface on said third support.

4. The container support apparatus of claim 2 in which said second support substantially surrounds said third support and said means for guiding movement of said first support relative to said second support in a direction corresponding to a first dimension of the inner vessel includes providing a space between said third support and said second support and an inner vessel bearing surface on said second support.

5. The container support apparatus of claim 2 in which said support unit formed from said first, second, and third supports include a plurality of said support units.

6. The container support apparatus of claim 1 which additionally comprises means for distributing loads exerted at said support unit.

7. The container support apparatus of claim 6 in which said load distributing means comprises a pad affixed to the exterior of the inner vessel; and a stiffener circumferentially affixed to the inner vessel with a portion thereof positioned opposite said pad, said paid affixed to said first support.

8. The container support apparatus of claim 7 in which said load distributing means additionally comprises a longitudinally affixed stiffener affixed to the interior of the inner vessel a portion of which is positioned opposite said pad with said inner vessel being intermediate said pad and said portion of said longitudinally affixed stiffener, said pad affixed to said first support.

9. The container of claim 1 in which additionally comprises means for guiding said first support relative to said second support in a direction corresponding to a second dimension of the inner vessel, and said means for limiting migration of the mobile solid matter to said means for guiding said first support relative to said second support along a second dimension of the inner vessel further provides means adapted for limiting migration of the solid matter to said means for guiding said first support relative to said second support in a direction corresponding to a second dimension of the inner vessel.

10. A container support apparatus for a container having an outer vessel and an inner vessel and mobile solid matter, being a poor conductor of heat, interposed the inner and outer vessels comprising:

a. a first support adapted for fixation to the inner vessel;

b. a second support adapted for fixation to the outer vessel;

c. a third support contacting said first and second supports, said first, second and third supports forming first holding means adapted for supporting the inner vessel in spaced relationship to the outer vessel against a gravitational force;

d. means adapted for heat insulating the inner vessel from the outer vessel;

e. means for guiding movement of said first support in relation to said second support in a direction inwardly relative to the inner vessel; and f. means adapted for limiting migration of the mobile solid matter from between the inner and outer vessels to said means for guiding said first support relative to said second support along a first dimension of the inner vessel.

11. The container support apparatus of claim 10 in which the first vessels is elongated bodies and said first and second holding means are located inwardly from the ends of the elongated vessels.

12. The container support apparatus of claim 10 in which said first holding means additionally comprises means for supporting the inner vessel in spaced relationship to the outer vessel against a lateral force relative to the force of gravity.

13. The container support apparatus of claim 10 in which said inner and outer vessels are elongated bodies and said first holding means additionally comprises means for guiding said first support in relation to said second support in a direction parallel to the axis of elongation of the first vessel, forming second holding means thereby.

14. The container support apparatus of claim 13 which includes a plurality of said second holding means located about the periphery of said inner vessel.

15. The container support apparatus of claim 14 which includes at least a pair of said first holding means spaced one hundred eighty degrees apart on said container.

16. The container support apparatus of claim 13 in which said first and second holding means includes a plurality of the same located about the periphery of said elongated bodies and where a pair of said first holding means are located one hundred eighty degrees apart on said container and a pair of said second holding means are located one hundred eighty degrees apart on said container.

17. The container support apparatus of claim 16 in which the inner vessel includes baffle means for diminishing the movement of cryogenic materials therewithin.

18. The container support apparatus of claim 17 in which said baffle means includes a multiplicity of baffles asymmetrically spaced within the inner vessel.

19. The container support apparatus of claim 16 in which said one of said pair of said first holding means and one of said pair of said second holding means are spaced ninety degrees from each other on the periphery of the inner vessel.

20. The container support apparatus of claim 19 in which said pairs of first and second holding means are substantially coplanar.

21. The container support apparatus of claim 19 in which said pairs of first and second holding means are located on one half of the inner vessel and further comprises a plurality of second holding means located on the other half of the inner vessel.

22. The container support apparatus of claim 13 in which the vessels have a cylindrical portion and said means for guiding said first support in relation to said second support in a direction inwardly relative to the inner vessel operates in a radial direction with respect to said cylindrical portion.

23. The container support apparatus of claim 13 in which the inner and outer vessels are elongated bodies and said first and second holding means are located inwardly from the ends of said elongated bodies.

* * * * *